US005174222A

United States Patent [19]

Rogers

[11] Patent Number: 5,174,222

[45] Date of Patent: Dec. 29, 1992

[54] APPARATUS FOR CLEANING OF SHIP HULLS

[76] Inventor: Mark C. Rogers, 4787 Crisp Way, San Diego, Calif. 92117

[21] Appl. No.: 787,652

[22] Filed: Nov. 4, 1991

[51] Int. Cl.[5] ..... B63B 59/00

[52] U.S. Cl. ..... 114/222

[58] Field of Search ..... 15/1.7; 403/23, 288; 114/222; 440/83

[56] References Cited

U.S. PATENT DOCUMENTS 2,961,988 11/1960 Wood ..... 440/83 X 4,697,536 10/1987 Hirata ..... 114/222

*Primary Examiner*—Sherman Basinger

*Attorney, Agent, or Firm*—Brown, Martin, Haller & McClain

[57] ABSTRACT

A device is disclosed for in-water cleaning of a ship's hull. The device includes a body having inboard and outboard faces joined by a peripheral side, the faces having coaxial central apertures which are joined to form a central opening through the body, in which is mounted a hydraulic motor-driven propeller. The propeller maintains the device in contact with the hull during cleaning. There are detachable wheel modules recessed into the body to propel the device along the hull and a hydraulic motor-driven steering wheel to steer the device. Hydraulically driven cleaners are mounted on the inboard face to clean the hull. There is also a light recessed into the peripheral side to provide illumination to the hull. The device may also include an adjustable buoyancy chamber mounted on the body to provide sufficient buoyancy to the device to enable the device to effectively clean the hull at the waterline. Also disclosed is a unique double bearing for mounting each of the wheels, cleaning means and propeller which prevents hydraulic fluid leakage and permits easy demountable of the compounds.

16 Claims, 2 Drawing Sheets

APPARATUS FOR CLEANING OF SHIP HULLS

BACKGROUND OF THE INVENTION

1. Field of the Invention

The invention herein relates to devices for cleaning of ships' hulls. More particularly, it relates to hull cleaning devices which are used while the ship remains in the water, either at pierside or at anchor.

2. Description of the Prior Art

It has been known for centuries that the growth of marine organisms on the hull of a ship is adverse to the ship's sailing performance, particularly its potential speed. Many techniques have been used over the years to remove such marine growth from the hulls. In sailing ship days, ships were often careened on the beach to have their hulls scrubbed clean. Since the advent of dry docks, ships can be put into dry dock for hull cleaning. However, use of a dry dock is undesirable, since when a ship is in dry dock for simple hull cleaning, the dry dock cannot be used for service to other ships, particularly repair services for which dry docks are uniquely suited. In addition, in many places dry docks are not available.

Since careening and dry docking are difficult, expensive, and often dangerous to both ship and workers, numerous techniques have been considered to accomplish hull cleaning while the ship remains in the water, either at anchor or secured to a shore structure such as a pier. The simplest technique, that of putting divers down to clean the hull manually, is very slow, labor intensive and dangerous. Consequently, mechanical hull cleaning devices have been developed which move along the hull underwater and mechanically scrub the accumulated marine organisms cleaning propulsion and steering mechanisms. The use of electrical power for these major functions of the device poses substantial problems, however, particularly disengagement of the device from the hull if power fails and potential electrical hazard to the diver/ operator if a short circuit occurs or the diver inadvertently comes into contact with the electrical system.

Several years after the appearance of the electrohydraulic devices, I developed and introduced a much safer and more efficient hull cleaning device entirely powered and controlled hydraulically, with no electrical requirements for any cleaning, steering or propulsion mechanism or function. Devices of this type used readily available hydraulic fluids and have hydraulic pumps mounted out of the water, usually on a pier or the ship's deck. Back-up power to the pumps is readily available so that the diver/operator can safely and efficiently use and control the device without being at risk of electrocution. For the past several years, these devices have proved very successful and have been used by numerous navies and merchant fleets for hull cleaning of many types of warships and merchant ships, including very large vessels such as battleships and supertankers.

However, experience in service has shown that these hydraulic devices, while superior to any other type of hull cleaning device, still have several deficiencies which require time and expense to cope with. For instance, they cannot readily be used at the water line, since the reduced amount of suction created when the device is partially above water is not sufficient to support the weight of the device (a problem also with the electrohydraulic devices). Further, the wheeled propulsion and steering mechanisms of these devices will eventually become clogged with debris from the cleaning and may also suffer corrosion failures. In such cases, the devices must be brought ashore or on deck and mechanisms must be disassembled and replaced, a procedure which is quite difficult and requires substantial rebuilding of the units. In addition, it has been conventional practice that the mounting structures must be open, thereby allowing water into the interior of the unit where corrosion can occur.

SUMMARY OF THE INVENTION

The invention herein is a device for in-water cleaning of a ship's hull which comprises a body having a substantially flat inboard hull-facing face, an opposed outboard face and a peripheral side therebetween, the side and the faces together defining an interior chamber in the body; the inboard face and the outboard face each having a central aperture therein, the apertures being axially aligned and joined by an interior wall, the apertures and wall defining a central opening through the body; a hydraulic motor-driven propeller disposed in the opening to draw water through the opening in the direction from the inboard face to the outboard face, thereby creating a reactant force to maintain the device in contact with the hull during cleaning; at least three detachable wheel modules recessed into the body through the inboard face, the modules including at least one driving module comprising a hydraulic motor-driven driving wheel adapted to propel the device along the hull and a steering module comprising a steerable hydraulic motor-driven steering wheel adapted to steer the device as it traverses along the hull; at least one hydraulically driven cleaning means mounted on the inboard face and adapted to be in contact with and clean the hull; a hydraulic pump to drive the hydraulic motors on the modules, cleaning means and propeller and detachable conduits to provide fluid connections between the motors and the pump; means to steer the steerable wheel; and at least one light recessed into the peripheral side to provide illumination to the hull in the area adjacent to the device as the device traverses the hull during cleaning thereof.

In a preferred embodiment, the device also comprises at least one buoyancy bladder mounted on the body, the bladder being adapted to be collapsed while the device is fully submerged and to be inflated to provide sufficient buoyancy to the device to enable the device to be partially disposed above the ship's waterline while maintaining sufficient adherence to the hull to effectively clean the hull at the waterline.

The invention further comprises a unique double bearing for mounting each of the wheels, cleaning means and propeller in an easily demountable manner, the bearing comprising a cylindrical annular body having a ball race and ball bearings at each end thereof; a coaxial shaft rotatably mounted within the body and rotatable through the ball bearings, the shaft having at one end thereof an axial hole to receive a motor drive shaft and being extended outwardly of the body at the other end to engage and drive a rotatable mechanism; and means for detachably mounting the body onto a drive motor.

DETAILED DESCRIPTION AND PREFERRED EMBODIMENTS

Figure 1:
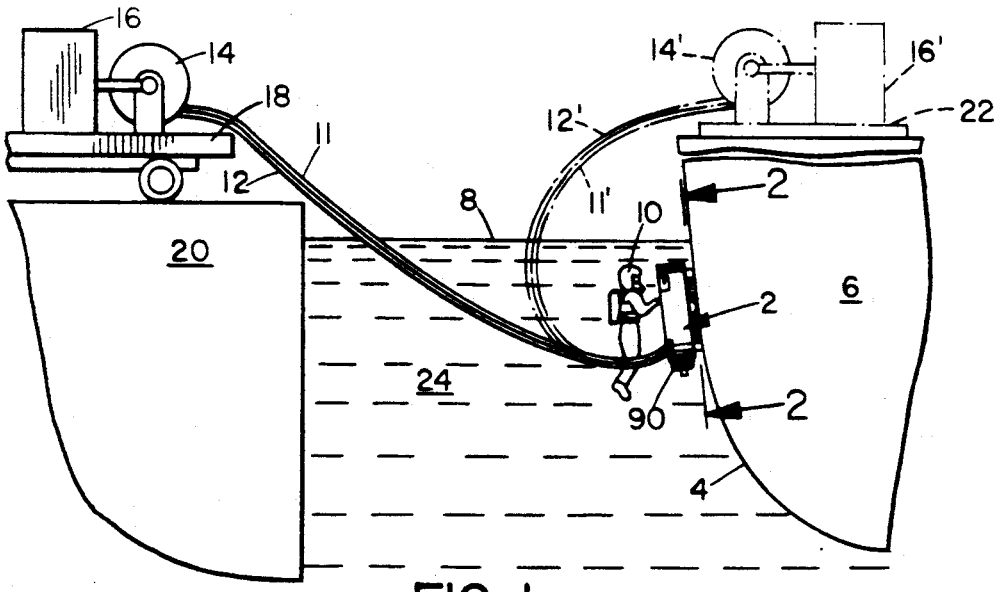
FIG. 1 is a schematic view illustrating a device of the present invention in use.
Figure 2:
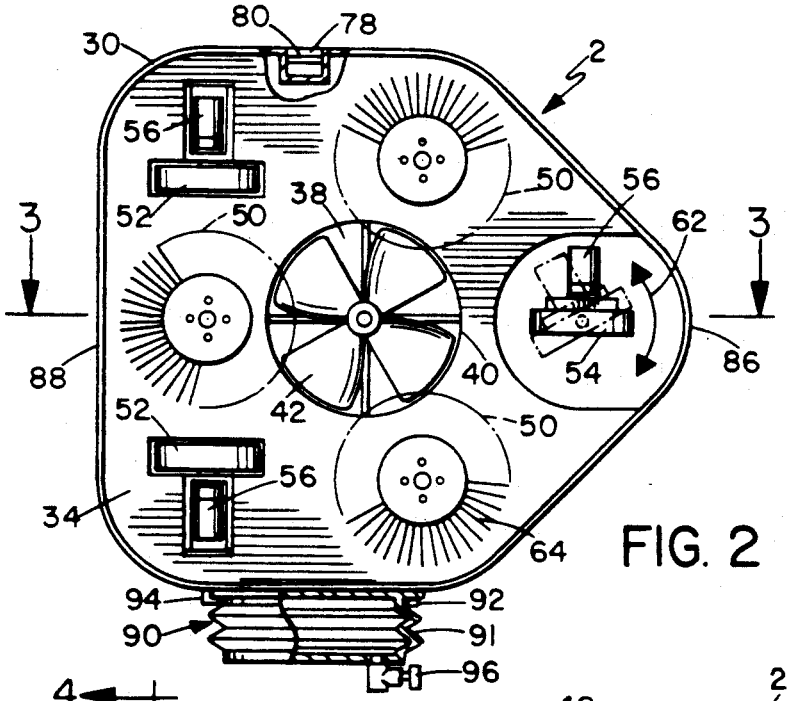
FIG. 2 is a bottom (inboard) plan view (partially in section and cut-away) of a device of the present invention taken as on LINE 2—2 of FIG. 1.
Figure 3:
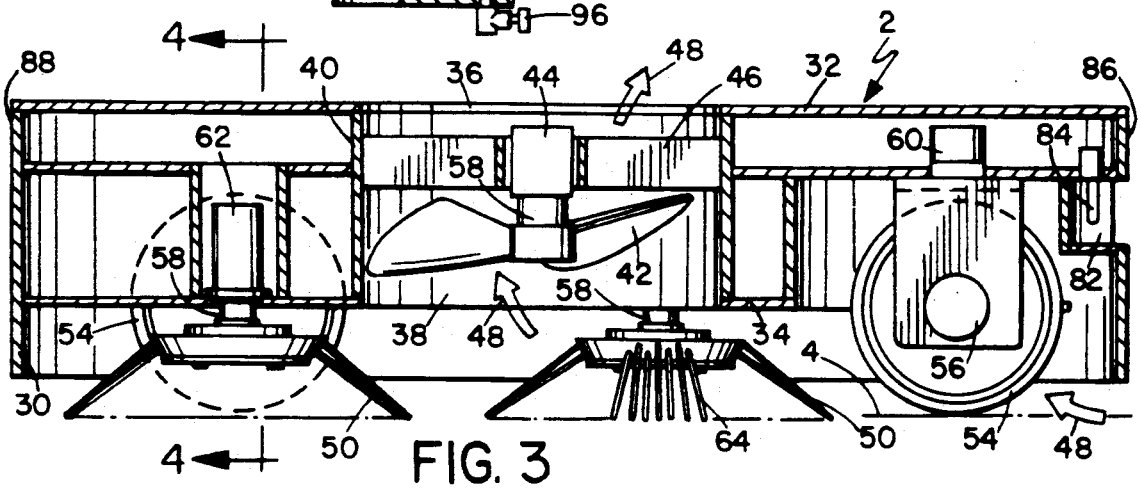
FIG. 3 is a enlarged sectional view of the device of FIG. 2 taken on LINE 3—3.

The device of this invention will be best understood by reference to the Figures of the drawings. In FIG. 1 a device of the present invention, generally designated 2, is shown in use cleaning the outer surface of the hull 4 of a ship 6 in the area below the water line 8. The device is guided and operated by a diver 10. As will be noted below, it is also possible to utilize remote control for the device of this invention. Commercial hydraulic fluid is supplied to the device for control and propulsion by hydraulic lines 11 and 12 which are mounted through take-up reel 14 to hydraulic pump 16, which provides a constant hydraulic pressure for the various steering, propulsion and cleaning mechanisms which will be described below. In FIG. 1, the hydraulic pump 16 is shown mounted on a truck or trailer 18 which is parked on a pier 20 to which the ship 6 is moored. Alternatively, as indicated by in phantom lines, the take-up reel 14' and pump 16' can be mounted on the deck 22 of ship 6 and use lines 11' and 12' to operate the equipment, if the ship were moored away from a pier or lying at anchor. The device 2 can be used when completely submerged in the body of water 24 in which the ship is floating or can be used only partially submerged with a portion above the water line 8, so that the ship's hull 4 can be cleaned thoroughly, even along water line 8.

Details of the devices of this invention are illustrated in FIGS. 2-5. An outer casing 30, which is generally about 18-24 inches (45-60 cm) high and approximately 5-6 feet (1.5-1.8 m) in each of its length and width dimensions, completely surrounds the device. The remainder of the hull structure of the device 2 is provided by outboard (top) plate 32 and inboard (bottom) plate 34, which are bolted or preferably welded to casing 30 to form a generally hollow enclosed body shell. (The terms "inboard" and "outboard" are used herein with reference to facing toward or away from the ship's hull 4 when in operation.)

Both outboard and inboard plates 32 and 34 have centrally located therein openings 36 and 38 respectively which are circular and which are bounded by a cylindrical wall 40 forming an open cylindrical chamber in which is mounted propeller 42. Propeller 42 is driven by hydraulic motor 44 mounted on struts 46 which are attached to wall 40. In operation propeller 42 draws water in from the inboard side of device 2 in the opening formed between the bottom edge of casing 30 and the ship's hull 4 (indicated by phantom lines in FIG. 3). The water flow thus follows arrows 48 and creates a reaction which urges the device 2 against the hull 4 of the ship. The driving force of the propeller 42 is sufficient to hold the device 2 snugly against the hull 4 of ship 6 against the irregularities of the marine organisms on the hull 4 and the vibrational forces of the cleaning devices 50 but not to create such a great force that the device cannot be propelled along the hull of the ship as described below. Typically the reaction force created by the propeller 42 to maintain the unit 2 against the ship's hull 4 is at least about 2000 pounds (8900 N).

The device 2 is propelled by at least one fixed driving wheel 52 and a steerable wheel 54, each of which is driven by a hydraulic motor 56. Each drive motor 56 is connected to its wheel 52 or 54 by a unique bearing structure 58 which will be described below. The same type of bearing structure may also used to connect motor 44 with propeller 42 and cleaning mechanisms 50 with their drive motors 62. Steerable wheel 54 is equipped with pivoting hydraulic driven steering mechanism 60 which allows for a limited amount of steering motion as indicated by arrow 62. The hydraulic force supplied to the driving motors 56 is sufficient to propel the device 2 along the ship's hull at a rate up to approximately 120 ft/min (37 m/min). The tractive effort of the wheels 52 and 54 is approximately 700 pounds (3100 N). This traversing speed is such that in approximately one to two days large naval vessels and merchant ships can be cleaned thoroughly of marine growth having a thickness of up to about 6 inches (15 cm). The economic saving to the ship owner based on hull cleaning twice a year for large vessel may be as much as $30,000-$50,000 per day in fuel and operating expenses for each day of sailing time saved with a clean hull. Thus a large vessel, which typically averages a speed of 13 knots, can cut three days off a 15,000 mile cruise with a clean hull, which will result in $90,000-$150,000 in fuel and operating costs savings. Smaller ships which use less fuel and have smaller crews will have less savings in terms of money, but the savings will be proportionately equivalent.

While all wheels 52 and 54 are shown powered in the embodiment illustrated, it is possible to have one or more of the wheels be an unpowered idler wheel. Of course, a sufficient number of wheels 52 and 54 must be powered to adequately propel the device 2. However, since it is intended to complete a cleaning job as quickly as possible, it is preferred that all wheels be powered. Should there for some reason be a power failure to any specific wheel, the remaining wheels will provide sufficient tractive force to drive the device at a reduced, but still acceptable, speed until the failed wheel can be replaced.

Mounted on the inboard of device 2 are cleaning brushes 50. These are approximately 2-3 feet (60-90 cm) in diameter. Each brush is driven by a hydraulic motor 62 acting through a bearing 58. Normally the brush bristles 64 will be of flexible metal, usually stainless steel, or plastic, usually polypropylene. The brushes 50 used on the present device are designed such that the bristles 64 extend outwardly at an angle of about 39° from the horizontal and are sufficiently flexible that approximately the last 4 inches (10 cm) will lie flat against the ship's hull 4. This allows the device 2 to do a thorough cleaning of the hull without damaging the anti-fouling paint with which most ship hulls are coated. This is of particular importance, since anti-fouling paints are quite expensive and to repaint even a portion of a ship's hull requires dry docking the ship, with the attendant costs of dry docking plus the lost revenue when the ship is out of service.

Figure 4:
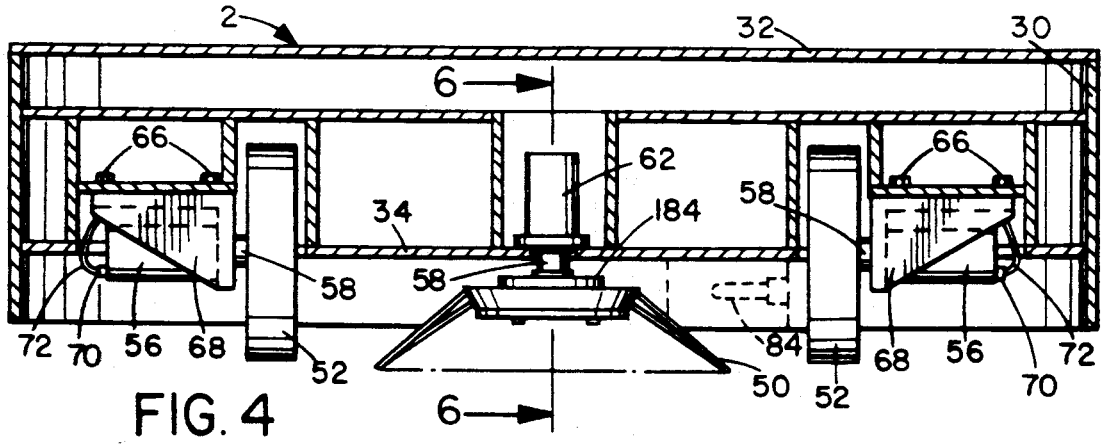
FIG. 4 is a sectional view of the device of FIG. 3 taken on LINE 4—4.
Figure 5:
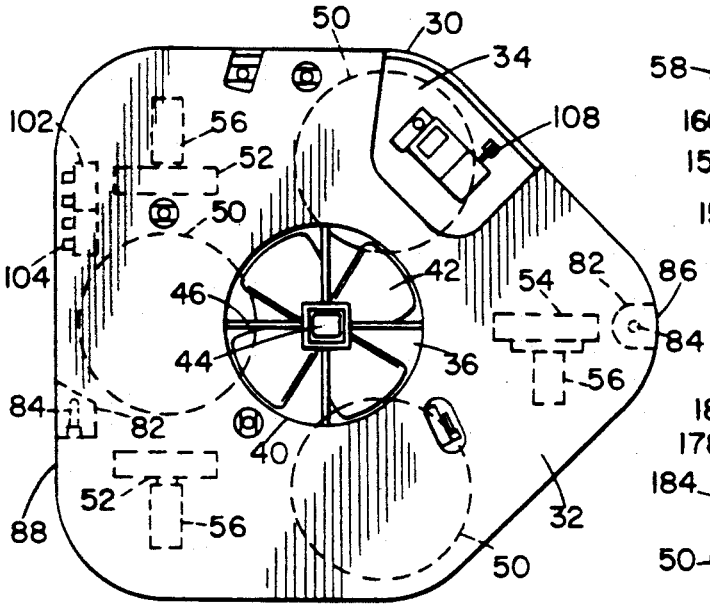
FIG. 5 is a top (outboard) plan view of the device of FIG. 2.

Unique to the present invention is the modular construction of the motor/wheel units 52/56 and 54/56, which is best illustrated in FIG. 4. Each of the motor/-wheel units can be removed as a unit simply by undoing bolts 66 which hold bracket 68 to which motor 56 is mounted and by disconnecting coupling 70 to hydraulic line 72. This is a very important element of the present invention since it permits a defective or failed motor/-wheel unit to be replaced easily by the diver 10 while the device 2 remains submerged, rather than having to bring the device 2 onto shore or the ship's deck for repairs. Since the device 2 must be moved away from the hull 4 and the propeller 42 stopped to permit the motor/wheel unit change over, however, it is necessary to provide for alternative support of the device 2. This can be accomplished by using a cable and hook suspended from a boom on shipboard or pier side (not shown) which engages a support bar 80 incorporated into a recess 78 formed in the casing 30.

Also formed in the wall 30 are recesses 82 in which are mounted lights 84. These lights, which are mounted generally at the forward end 86 and on the aft side 88 of the device, provide illumination of the ship's hull and marine growth to a range sufficient to allow the diver 10 to properly steer the device 2 and to ensure that all of the marine growth is removed by one or more passes of the device. The lights 84 are the only electrically powered components of the device 2 and since the electric power for the lights does not participate in the propulsion, control or steering of device 2, the electrical supply line can be effectively insulated from the rest of the device 2 such that a failure of the electrical line will not pose any danger to the diver 10 or the device 2.

In a preferred embodiment, the device 2 has incorporated into or attached to the lower side thereof a buoyancy chamber 90. This air-tight chamber 90 will normally be in the form of a bellows 91 made of a flexible metal, such as aluminum. The chamber 90 is removably attached to the casing 30 of the device 2 as by bolts 92 or clamps 94. The chamber 90 is initially partially filled with air through valve 96 either before or after being attached to the casing 30. Thereafter the degree of buoyancy provided can be varied simply by adding more air through valve 96 to expand bellows 91 or releasing air through valve 96 to compress bellows 96, thus changing the volume of chamber 90. When need for the buoyancy chamber 90 is finished, preferably the valve 96 is opened to allow release of air until the air and water pressure are equalized, and then the bolts 92 or clamps 94 can be removed and the chamber 90 separated from the device 2 and recovered. Optionally the chamber can be removed without pressure equalization, but then the diver 10 and the shipside or shoreside personnel must be sure to compensate for the independent buoyancy of the chamber 90 when they recover it once it is separated from the device 2.

Figure 7:
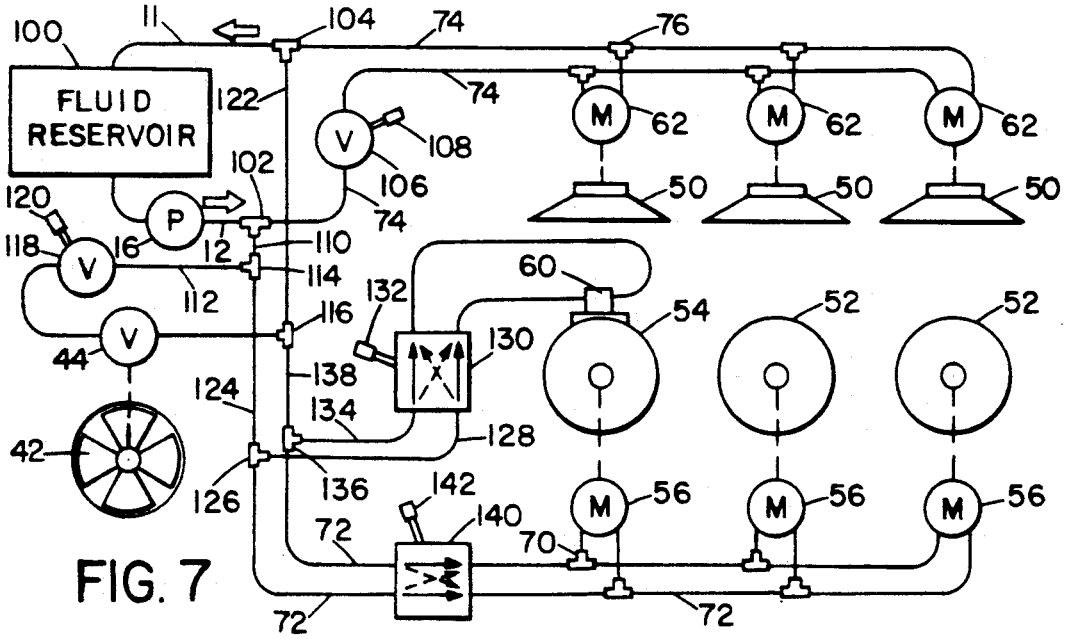
FIG. 7 is a schematic diagram of the hydraulic power and control system of the device of this invention.

FIG. 7 illustrates an embodiment of the hydraulic control system and propulsion of the present invention. A hydraulic fluid reservoir 100, which will be mounted generally adjacent to pump 16, supplies hydraulic fluid to line or conduit 12 which conducts it to a manifold 102 which is mounted within the hull of the device 2. From manifold 102 hydraulic fluid is directed through line 74 to couplings 76 and motors 62 and then returned via manifold 104 and line 11. Valve 106 which is operated by lever 108 is mounted in line 74 to allow diver 10 to control the operation and speed of motors 62 which drive cleaning units 50. Another line 110 from manifold 102 is routed to manifold 114, from which line 112 is routed to drive motor 44 which powers propeller 42. The operation and speed of motor 44 is controlled by valve 118 operated by diver 10 through lever 120. The hydraulic fluid then flows to manifold 116 where it is routed back through line 122 to manifold 104 to be returned to the fluid reservoir 100 through line 11.

From manifold 114 line 124 is routed to manifold 126. From manifold 126 is routed line 128 which drives the steering motor 60 through reversing valve 130 whose direction is controlled by lever 132. The hydraulic fluid after passing through valve 130 is returned through line 134 to manifold 136 and line 138 to be returned to the fluid reservoir 100 through lines 122 and 11.

Finally, also routed from manifold 126 is line 72 which drives motors 56 through couplings 70. The speed and operation of motors 56 are controlled by valve 140 through lever 142. Fluid passes through manifold 136 and returns to the fluid reservoir in the same manner as described for other fluid lines above.

It is possible to operate the device 2 remotely, as from the ship's deck 22 or the pier 20, by attaching a television camera (not shown) to the forward end 86 or outboard plate 32 of the device, and making the control and steering valves 106, 118 and 130 remotely operable through conventional remote valve operation devices (not shown). Such may be useful for cleaning of ships moored or docked in exceptionally cold waters, such as in the Arctic or Antarctic regions, where a diver cannot work for extended periods.

Figure 6:
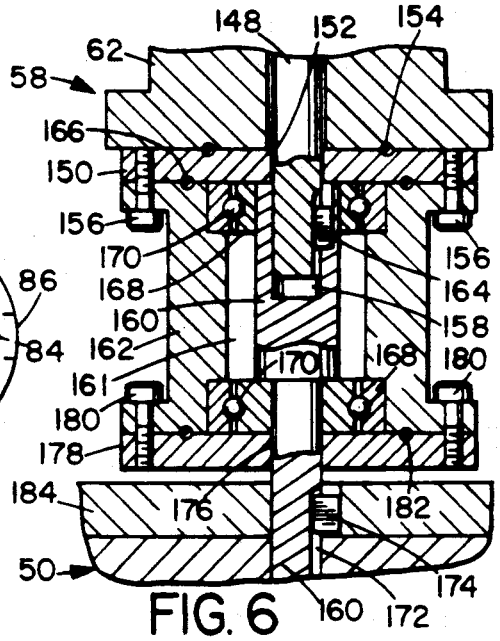
FIG. 6 is an enlarged sectional view of a portion of this invention taken on LINE 6—6 of FIG. 4.

FIG. 6 illustrates a unique "double" bearing 58 particularly suited for use in the device 2 of this invention, since it prevents leakage of fluid from the hydraulic system at the point where most prior devices were most likely to leak. The hydraulic system is under high pressure, and a system leak can permit the rapid loss of large amounts of hydraulic fluid, which disables the equipment, often poses a fire risk and causes environmental problems. Further, the use of these bearings permit removal of the wheel mechanisms, the propeller or the cleaning brushes without affecting the water-tight and pressure-tight integrity of the hydraulic motors. In FIG. 6 the bearing as illustrated is part of the drive mechanism for the brush 50 shown in FIG. 4. Motor 62 has projecting therefrom rotatable drive shaft 148. A plate 150 with a central hole 152 is bolted to the face of motor 62 with bolts 156 so that shaft 148 projects through hole 152 into a keyed hole 158 in the central shaft 160 of bearing 58, and is fixed with relation to the hole 158 by key 164. 0-ring 154 seals between plate 150 and the face of motor 62. A hollow annular member 162 forms the outer body of bearing 58, is secured at one end to plate 150 by bolts 156, and is sealed by 0-ring 166. Heavy grease is packed into the annular chamber 161 formed the inner surface of member 162 and the outer surface of shaft 160, to aid in preventing any leakage of hydraulic fluid. Bearing races 168 are mounted at each end of shaft 160 within annular member 162 and filled with balls 170 so that shaft 160 is free to rotate within member 162 as motor shaft 148, to Which it is keyed, rotates. The end of shaft 160 opposite to motor 62 is reduced in diameter as shown at 160', and has a keyway 172 in which is key 174. The reduced diameter shaft 160' extends through a central hole 176 in outer plate 178, which is bolted to the end of annual member 162 by bolts 180 and sealed by O-ring 182. Key 174 locks shaft 160' to the top 184 of brush structure 50, so that the brush structure Will also rotate with motor shaft 152.

Use of this unique bearing 58 allows for simple and convenient removal and replacement of any of the brushes 50 or wheels 52 or 54 or the propeller 42. The bearing may be removed simply by unbolting bolts 156 to decouple the bearing 58 from the motor 62, which remains in place. The brush structure 50 and bearing 58 are then removed and a new brush/ bearing unit put in place and attached by rebolting bolts 156. The removed unit can then be transported to a repair shop for repair or reconstruction. The same ease of removal and replacement will be evident for each wheel and the propeller by use of the bearings 58.

It will be evident that there are numerous embodiments of the present invention, which were not expressly described above, are clearly within the scope and spirit of the invention. Consequently, the above description is intended to be exemplary only, and the invention is to be limited solely by the appended claims.

I claim:

1. A device for in-water cleaning of a ship's hull which comprises:

a body having a substantially flat inboard hull-facing face, an opposed outboard face and a peripheral side therebetween, said side and said faces together defining an interior chamber in said body;

said inboard face and said outboard face each having a central aperture therein, said apertures being axially aligned and joined by an interior wall, said apertures and wall defining a central opening through said body;

a hydraulic motor-driven propeller disposed in said opening to draw water through said opening in the direction from said inboard face to said outboard face, thereby creating a reactant force to maintain said device in contact with said hull during cleaning;

at least three detachable wheel modules recessed into said body through said inboard face, said modules including at least one driving module comprising a hydraulic motor-driven driving wheel adapted to propel said device along said hull and a steering module comprising a steerable hydraulic motor-driven steering wheel adapted to steer said device as it traverses along said hull;

at least one hydraulically driven cleaning means mounted on said inboard face and adapted to be in contact with and clean said hull;

a hydraulic pump to drive said hydraulic motors on said modules, cleaning means and propeller and detachable conduits to provide fluid connection between said motors and said pump;

with each of said modules, cleaning means and propeller being mounted to said one of said hydraulic motors through a bearing comprising:

a cylindrical annular body having a ball race and ball bearings at each end thereof; and a coaxial shaft rotatably mounted within said body and rotatable through said ball bearings, said shaft having at one end thereof an axial hole to receive a motor drive shaft and being extended outwardly of said body at the other end to engage and drive a rotatable mechanism;

means to steer and steerable wheel; and at least one light recessed into said peripheral side to provide illumination to the hull area adjacent to said device as said device traverses said hull during cleaning thereof.

2. A device as in claim further comprising at least one buoyancy chamber removably mounted on said body, said chamber being air-tight and adapted to be inflated to provide sufficient buoyancy to said device to enable said device to be partially disposed above the ship's waterline while maintaining sufficient adherence to said hull to effectively clean said hull at said waterline.

3. A device as in claim 2 wherein said chamber comprises a bellows which can be expanded or contracted by injection or removal of air to vary its volume and thereby vary the degree of buoyancy provided to said device.

4. A device as in claim 3 wherein said chamber contains a valve for said injection or removal of air.

5. A device as in claim 3 wherein said bellows is formed of a flexible metal.

6. A device as in claim 1 wherein each of said cleaning units and said propeller are mounted to said device through a demountable double bearing.

7. A device as in claim wherein said cleaning means comprises a rotatable brush.

8. A device as in claim 7 wherein said brush has a plurality of bristles extending radially outwardly and adapted to be in contact with said hull, the rotation of said brush causing said bristles to sweep along said hull and clean said hull of fouling material adhering thereto.

9. A device as in claim 8 wherein said bristles are disposed at an angle of about 39° from the horizontal.

10. A device as in claim 8 wherein said bristles are formed from metal or plastic.

11. A device as in claim 10 wherein said bristles are formed from stainless steel or polypropylene.

12. A device as in claim 1 wherein each said wheel module comprises a bracket supporting a hydraulic motor to which is rotatably mounted a traction wheel, with hydraulic conduits to said motor being detachable.

13. A device as in claim 12 wherein said wheel is mounted to said motor through a double bearing.

14. A device as in claim 1 wherein said wheel modules area adapted to propel said device along said hull at a speed of up to 120 feet per minute.

15. A device as in claim 1 wherein said propeller is adapted to create a reactive adherent force of at least 2000 pounds.

16. A device as in claim 1 wherein there are a plurality of said lights adapted to provide illumination in at least both the forward and aft direction relative to said device.

* * * * *